US010066919B2

(12) United States Patent
Potter et al.

(10) Patent No.: US 10,066,919 B2
(45) Date of Patent: Sep. 4, 2018

(54) OILFIELD SIDE INITIATION BLOCK CONTAINING BOOSTER

(71) Applicant: OWEN OIL TOOLS LP, Houston, TX (US)

(72) Inventors: Benjamin O. Potter, Crowley, TX (US); Shaun M. Geerts, Crowley, TX (US); Matthew C. Clay, Burleson, TX (US)

(73) Assignee: OWEN OIL TOOLS LP, Houston, TX (US)

( * ) Notice: Subject to any disclaimer, the term of this patent is extended or adjusted under 35 U.S.C. 154(b) by 214 days.

(21) Appl. No.: 15/175,496

(22) Filed: Jun. 7, 2016

(65) Prior Publication Data

US 2016/0363428 A1 Dec. 15, 2016

Related U.S. Application Data

(60) Provisional application No. 62/173,175, filed on Jun. 9, 2015.

(51) Int. Cl.
*E21B 43/117* (2006.01)
*F42D 1/04* (2006.01)
(Continued)

(52) U.S. Cl.
CPC ..... *F42D 1/043* (2013.01); *E21B 43/117* (2013.01); *E21B 43/1185* (2013.01); *F42D 1/045* (2013.01)

(58) Field of Classification Search
CPC ..... E21B 43/1185; E21B 43/117; F42B 3/13; F42D 1/043; F42D 1/02; F42D 1/045; F42D 1/04
See application file for complete search history.

(56) References Cited

U.S. PATENT DOCUMENTS 3,524,408 A 8/1970 Edward
3,640,224 A 2/1972 John et al.
(Continued)

FOREIGN PATENT DOCUMENTS

EP 0679859 A2 11/1995
WO 0020820 A2 4/2000
(Continued)

OTHER PUBLICATIONS

PCT/US2016/036203—International Search Report dated Jun. 7, 2016.
(Continued)

*Primary Examiner* — Daniel P Stephenson
(74) *Attorney, Agent, or Firm* — Mossman, Kumar & Tyler, PC

(57) ABSTRACT

An initiation block for connecting a detonator with a detonating cord has a body that includes opposing first and second faces and a first and a second chamber extending between the opposing faces. The first chamber is formed by a first bore serially arranged with a second bore, which is shaped to seat the detonator adjacent to the second face. The second chamber is parallel with the first chamber and shaped complementary to the detonating cord. A passage provides communication between the first chamber and the second chamber. A booster is positioned in the first bore, proximate to the first face, and along the passage. The body further has an opening that provides communication between an exterior of the body and a portion of the chamber between the booster and the detonator.

11 Claims, 2 Drawing Sheets

(51) Int. Cl.
*F42D 1/045* (2006.01)
*E21B 43/1185* (2006.01)

(56) References Cited

U.S. PATENT DOCUMENTS 3,960,083 A 6/1976 Dietzel et al.
4,312,271 A 1/1982 Day et al.
4,592,280 A 6/1986 Shores
4,708,060 A 11/1987 Bickes, Jr. et al.
4,976,200 A 12/1990 Benson et al.
5,007,344 A * 4/1991 Ricles ..... E21B 23/02 102/312
5,094,167 A 3/1992 Hendley, Jr.
5,159,146 A * 10/1992 Carisella ..... E21B 43/1185 102/222
5,165,489 A * 11/1992 Langston ..... E21B 43/1185 175/4.54
6,412,388 B1 7/2002 Frazier
6,752,083 B1 6/2004 Lerche et al.
7,891,296 B2 2/2011 Husk et al.
8,601,948 B2 12/2013 Spring
2009/0090263 A1 4/2009 Han et al.
2010/0212480 A1 8/2010 Bell
2010/0229749 A1 9/2010 Veneruso
2011/0024116 A1 2/2011 McCann et al.
2011/0094745 A1 4/2011 Frazier et al.
2015/0027302 A1 1/2015 Wall et al.
2015/0053105 A1* 2/2015 Beikoff ..... F42B 3/26 102/318
2016/0363428 A1* 12/2016 Potter et al. ..... F42D 1/043

FOREIGN PATENT DOCUMENTS

WO 2012106640 A2 8/2012
WO 2014210275 A1 12/2014

OTHER PUBLICATIONS

A-140 F & Block; Fluid Disabled Resistorized Instantaneous RDX Detonator Assembly; Austin Powder Company.

* cited by examiner

OILFIELD SIDE INITIATION BLOCK CONTAINING BOOSTER

CROSS-REFERENCES TO RELATED APPLICATIONS

This applications claims priority from U.S. Provisional Application Ser. No. 62/173,175, filed Jun. 9, 2015, the entire disclosure of which is incorporated herein by reference in its entirety.

BACKGROUND OF THE DISCLOSURE

1. Field of Disclosure

The present disclosure relates to devices and methods for connecting detonators to detonating cords.

2. The Related Art

Detonators are often used in downhole operations to trigger controlled sequential detonations. Electric detonators operate by passing a current through a detonation resistor, which generates heat when current is applied. When sufficient heat is built up in the detonation resistor, the heat triggers a surrounding explosive charge, which serves as the first detonation in the sequence. The resulting explosion triggers the subsequent detonations by igniting a detonation cord that sets off additional explosive charges. The present disclosure addresses the need to reliably connect detonators with detonator cords.

SUMMARY OF THE DISCLOSURE

In aspects, the present disclosure provides an initiation block for connecting a detonator with a detonating cord. The initiation block may have a body having a first face; a second face opposing the first face; a first chamber extending between the opposing faces and through the body, the first chamber being formed by a first bore serially arranged with a second bore, the second bore being shaped to seat the detonator adjacent to the second face; a second chamber extending between the opposing faces and through the body, the second chamber being parallel with the first chamber, the second chamber shaped complementary to the detonating cord; a passage providing communication between the first chamber and the second chamber; a booster positioned in the first bore and proximate to the first face, the booster positioned along the passage; and an opening formed in the body, the opening providing communication between an exterior of the body and a portion of the chamber between the booster and the detonator.

In another aspect the present disclosure provides an apparatus for use in a wellbore. The apparatus may include a work string, a downhole tool, and an initiation block. The downhole tool has a fluid tight interior, a detonating cord, and a detonator. The initiation block is disposed inside the fluid tight interior. The initiation block may have a body having: a first face; a second face opposing the first face; a first chamber extending between the opposing faces and through the body, the first chamber being formed by a first bore serially arranged with a second bore, the second bore seating the detonator adjacent to the second face; a second chamber extending between the opposing faces and through the body, the second chamber being parallel with the first chamber, the second chamber receiving the detonating cord; a passage formed in a wall separating the first chamber and the second chamber, the passage providing the only communication inside of the body between the first chamber and the second chamber; a booster positioned in the first bore and proximate to the first face, the booster positioned along the passage; and an opening formed in the body, the opening providing fluid communication between an exterior of the body and a portion of the first chamber between the booster and the detonator.

In still further aspects, the present disclosure provides a method for activating a downhole tool in a wellbore. The method may include connecting the downhole tool, with the initiation block, to the work string; conveying the downhole tool through the wellbore using the work string; and transmitting an electric firing signal to the detonator of the downhole tool.

The above-recited examples of features of the disclosure have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

Figure 1:
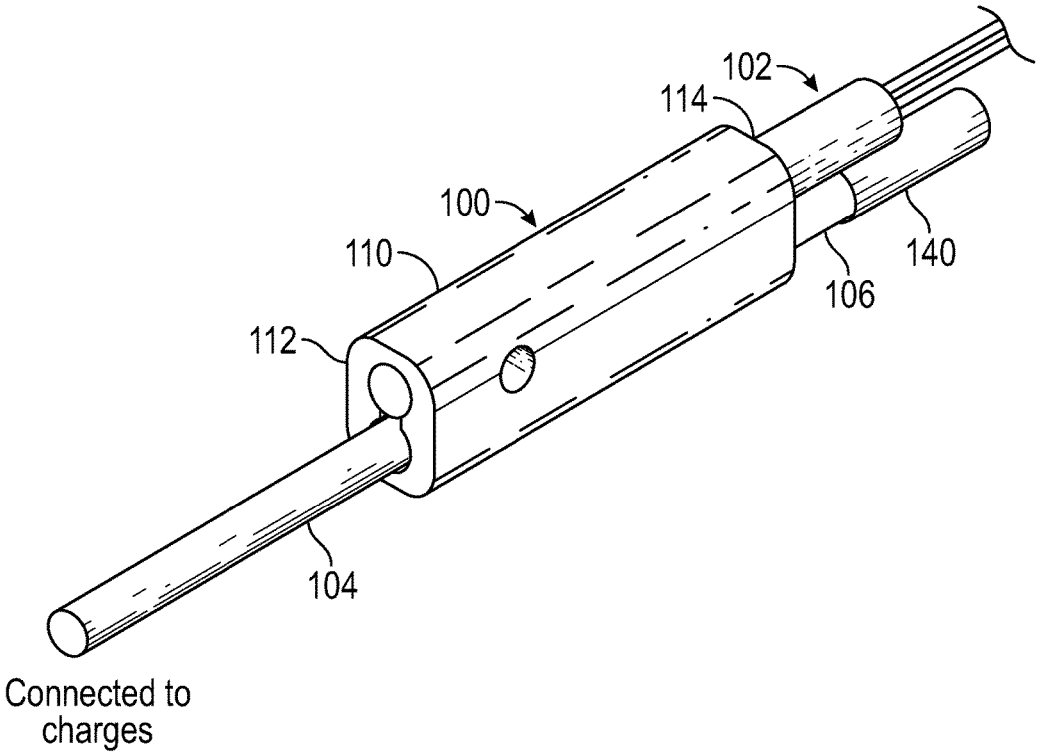
FIG. 1 is an isometric view of one embodiment of an initiation block according to the present disclosure.

The present disclosure provides an initiation block that allows a "crimpless" connection between a detonator and a detonator cord. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Referring to FIG. 1, there is shown an initiation block 100 that ballistically connects a detonator 102 to a detonating cord 104. The detonator 102 may be activated using an electric signal transmitted by suitable wiring. The initiation block 100 may include an elongated body 110 within which a portion of an end 106 of the detonating cord 104 is disposed. The body 110 has a first face 112 through which the detonating cord 104 is inserted through the body 110 and a second face 114 through which the detonator 102 is received into the body 110. As used herein the term "face" means an outer surface. The faces 112, 114 may be geometrically parallel in that they lie along parallel planes and may be considered "opposing" in that they are at opposite sides of the body 110.

Figure 2:
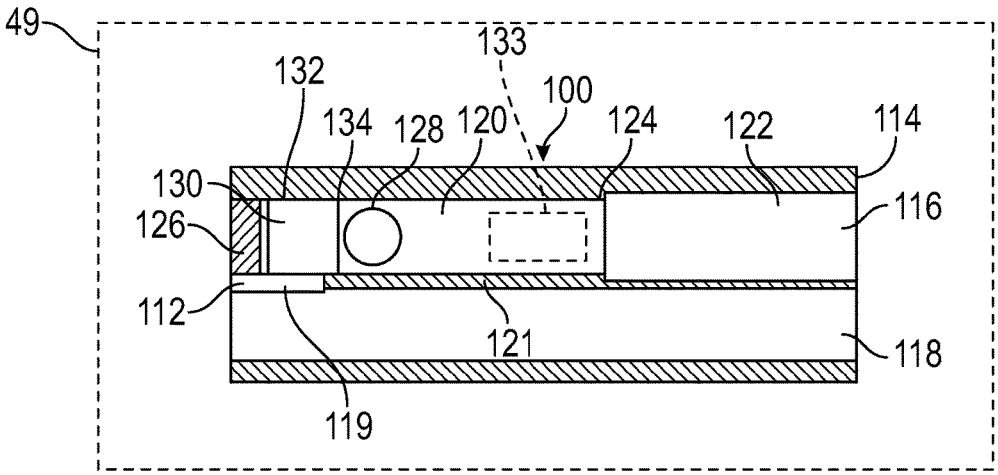
FIG. 2 is a schematic sectional view of the FIG. 1 embodiment.
Figure 3:
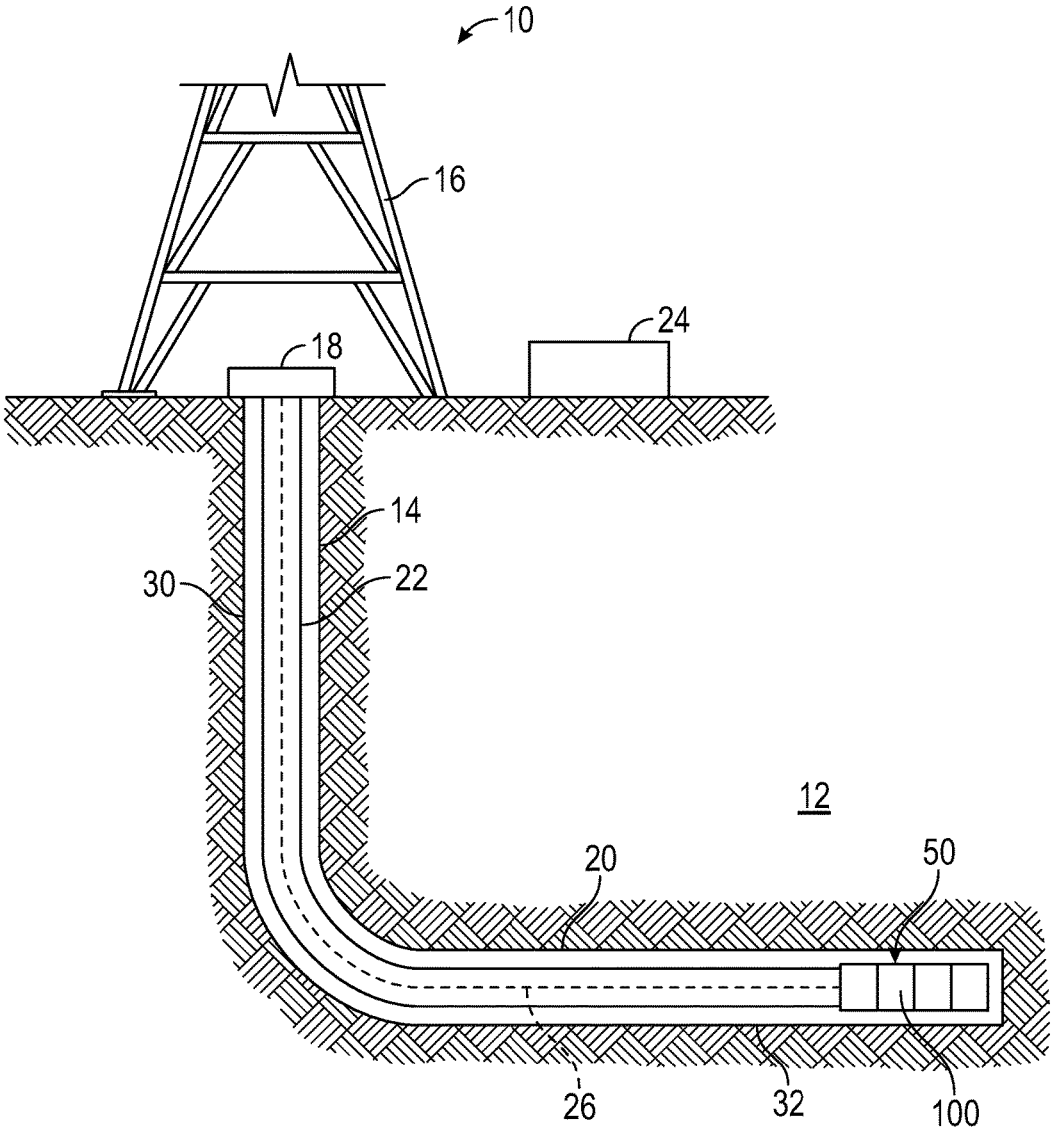
FIG. 3 schematically illustrates an elevation view of a surface facility adapted to perform one or more pre-defined tasks in a wellbore using one or more downhole tools.

Referring to FIG. 2, the initiation block 100 is shown positioned within an interior volume 49 of a downhole tool 50 (FIG. 3). The interior volume 49 is designed to be free of wellbore fluids; i.e., fluid tight. The body 110 includes a first chamber 116 in which the detonator 102 (FIG. 1) is positioned and a second chamber 118 that seats a length of the detonating cord 104. The chambers 116, 118 may be formed as cylindrical bores or passages that extend in a geometrically parallel fashion partially or completely through the body 110. A passage 119 formed in a wall 121 and proximate to the first face 112 allows unrestricted communication of ballistic energy between the two chambers 116, 118. Except for the passage 119, the two chambers 116, 118 are physically isolated from one another by the wall 121. That is, the body 110 does not have any other internal passages or openings connecting the two chambers 116, 118 through which energy can flow in an unrestricted fashion. The body 110 may be formed as an elongated body such as a cylinder or rectangular body.

In one embodiment, the first chamber 116 is formed by two serially aligned bores 120, 122. The bore 120 may be diametrically smaller than the bore 122 in order to form a shoulder 124. Also, closure element such as a plug 126 may be used to seal the bore 120 at the first face 112. The second bore 122 is sized and shaped to seat the detonator 102 next to the second face 114. The shoulder 124 may act as a seat to allow the detonator 102 to travel only a predetermined distance into the chamber 116. For reasons described below, an opening 128 may be formed in the body 110 in order to allow fluid communication between the first chamber 116 and the exterior of the body 110. For example, the opening 128 extends from an outer surface of the body 110 and terminates at the first chamber 116. The second chamber 118 has a profile selected to be complementary with the detonating cord 104. Thus, for detonating cords 104 with a circular cross-sectional shape, the chamber 118 may have a similar shape and size. The second chamber 118 can extend completely through the body 110 such that the end 106 of the detonating cord 104 projects out of the body 110.

In one arrangement, the initiator block 100 may include a booster 130 to generate a high order output for detonating the detonator cord 104. The booster 130 may be formed of an energetic material that is activated by the energy released by the detonator 102. Illustrative energetic materials include, but are not limited to, RDX (cyclotrimethylenetrinitramine or hexahydro-1,3,5-trinitro-1,3,5-triazine), HMX (cyclotetramethylenetetranitramine or 1,3,5,7-tetranitro-1,3,5,7-tetraazacyclooctane), TATB (triaminotrinitrobenzene). HNS (hexanitrostilbene), and other similar materials that are formulated to generate a high order output (i.e., thermal energy and shock waves). In some arrangements, the booster 130 is positioned within a cavity 132 that formed at an end of the bore 120. The plug 126 and a shoulder 134 secure and prevent axial movement of the booster 130 in the bore 120. This positioning allows selective and direct detonation of the detonating cord 104. Optionally, a second booster 133 may also be positioned in the bore 120. The opening 128 is formed between the booster 130 and the optional second booster 133.

Selective detonation is enabled by seating the booster 130 in the smaller bore 120 of the first chamber 116 and next to the first face 112. The opening 128 is formed between the booster 130 and the detonator 102 so that liquid outside of the body 110, if present, can fill the chamber 116 and form a liquid column between the booster 130 and the detonator 102 (and the optional second booster 133). This can occur if an enclosure or other structure that houses the initiator block 100 suffers a leak and allows entry of surrounding wellbore fluids. In such instances, the liquid column forms a physical barrier that blocks the energy released by the detonator 102 from activating the booster 130 or the detonating cord 104. The initiator block 100 may be considered "fluid disabled" when the liquid column is in the chamber 116.

A direct detonation of the detonating cord 104 is enabled by seating the booster 130 along the passage 119. Thus, no solid material physically separates the booster 130 from a portion of the detonating cord 104 inside the chamber 118. In some embodiments, the passage 119 does not extend axially beyond the booster 130. In such embodiments, the booster 130 completely covers the passage 119. This positioning allows the high order output of the booster 130 to travel without obstruction and impinge the detonating cord 104. It should be noted that because the chambers 116, 118 are arranged in a parallel fashion, the high order output travels in a radial/transverse direction from the bore 120 to the detonating cord 104.

In some embodiments, a ballistic interruption device (not shown) may be inserted into the opening 128 in order to prevent the initiation of the booster in the event of an accidental detonation of the detonator. The ballistic interruption device (not shown) may be a body or sufficient mass and strength to act as a shield for the booster 130. Using a ballistic interruption device (not shown) can allow an assembled gun to be transported in certain situations.

Referring to FIG. 3, there is shown a well construction and/or hydrocarbon recovery facility 10 positioned over a subterranean formation of interest 12. The facility 10 can include known equipment and structures such as a rig 16, a wellhead 18, and cased or uncased pipe/tubing 20. A work string 22 is suspended within the wellbore 14 from the rig 16. The work string 22 can include drill pipe, coiled tubing, wire line, slick line, or any other known conveyance means. The work string 22 can include telemetry lines or other signal/power transmission mediums that establish one-way or two-way telemetric communication. A telemetry system may have a surface controller (e.g., a power source) 24 adapted to transmit electrical signals via a cable or signal transmission line 26 disposed in the work string 22. To perform one or more tasks in the wellbore 14, the work string 22 may include a downhole tool 50 that is activated by a high-order detonation. In many instances, the downhole tool 50 has an interior volume that is sealed to prevent liquids. Having fluids penetrate into the downhole tool 50 is usually unconsidered an undesirable situation and can require that the intended operation be terminated.

Conventionally, the downhole tool 50 is conveyed by the work string 22 along the various sections of the wellbore 14 until a desired target depth is reached. The wellbore 14 may have a complex geometry that includes one or more vertical sections 30 and one or more deviated sections 32. Often, the wellbore 14 has a fluid column that may be composed of drilling fluids and/or fluids from the formation.

Referring to FIGS. 1-3, in one non-limiting mode of use, the downhole tool 50 is a perforating gun that is assembled at the surface using the initiator block 100, the detonator 102, detonating cord 104, and other known components that are not shown such as shaped charges, charge tube/strip, carrier housing, etc. In some embodiments, the booster 130 may be pre-installed in the body 110.

At the appropriate time, making up the connection between the detonator 102 and the detonating cord 104 may be done by first inserting the detonating cord 104 through the chamber 118 and capping the detonator cord end 106 with a detonating cord end seal 140. Next, the detonator 102 may be inserted into the bore 122 until it seats against the shoulder 124. The remainder of the perforating gun may be assembled and readied for deployment in a well.

Once the downhole tool 50 is positioned at a target depth, an electric firing signal is transmitted to the detonator 102. The detonator 102 releases thermal energy and shock waves, which travel through the bore 120 and activates the booster 130. When activated, the booster 130 generates a high order detonation. The thermal energy and shock waves associated with the detonation travel through the opening 119 and detonate the portion of the detonating cord 104 in the chamber 118. The detonating cord 104 thereafter transfers the detonation to shaped charges (not shown) or other detonation activated device.

If wellbore liquids were to leak into the downhole tool 50, those liquids would flow through the opening 128 and fill the space in the chamber 116 between the detonator 102 and the explosive booster 130. This liquid blocks the energy released by the detonator 102 from reaching the booster 130 and the detonating cord 104. Thus, activation of the booster 130 and the firing of the downhole tool 50, e.g., the perforating gun, is prevented.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. Thus, it is intended that the following claims be interpreted to embrace all such modifications and changes.

We claim:

1. An apparatus for use in a wellbore, comprising:
- a work string;
- a downhole tool conveyed by the work string, the downhole tool having a fluid tight interior, a detonating cord, and a detonator; and
- an initiation block disposed inside the fluid tight interior, the initiation block comprising a body having:
  - a first face;
  - a second face opposing the first face;
  - a first chamber extending between the opposing faces and through the body, the first chamber being formed by a first bore serially arranged with a second bore, the second bore seating the detonator adjacent to the second face;
  - a second chamber extending between the opposing faces and through the body, the second chamber being parallel with the first chamber, the second chamber receiving the detonating cord;
  - a passage formed in a wall separating the first chamber and the second chamber, the passage providing the only communication inside of the body between the first chamber and the second chamber;
  - a booster positioned in the first bore and proximate to the first face, the booster positioned along the passage; and
  - an opening formed in the body, the opening providing fluid communication between an exterior of the body and a portion of the first chamber between the booster and the detonator.

2. The apparatus of claim 1, wherein the detonating cord extends through the first face of the body and an end of the detonating cord projects out of the second face of the body.

3. The apparatus of claim 1, wherein the detonator is activated using an electric signal.

4. The apparatus of claim 1, wherein a gap separates the booster from the detonator, wherein the gap is configured to form a liquid column that separates the booster from the detonator using any liquid that flows through the opening.

5. The apparatus of claim 1, wherein the body is elongated.

6. An initiation block for connecting a detonator with a detonating cord, the initiating block comprising:
- a body having:
  - a first face;
  - a second face opposing the first face;
  - a first chamber extending between the opposing faces and through the body, the first chamber being formed by a first bore serially arranged with a second bore, the second bore seating the detonator adjacent to the second face;
  - a second chamber extending between the opposing faces and through the body, the second chamber being parallel with the first chamber, the second chamber receiving the detonating cord;
  - a passage formed in a wall separating the first chamber and the second chamber, the passage providing the only communication inside of the body between the first chamber and the second chamber;
  - a booster positioned in the first bore and proximate to the first face, the booster positioned along the passage; and
  - an opening formed in the body, the opening providing fluid communication between an exterior of the body and a portion of the first chamber between the booster and the detonator.

7. The initiation block of claim 6, wherein the first and the second chambers are cylindrical bores that are geometrically parallel, and wherein the passage communicates energy in a direction transverse to the cylindrical bores.

8. The initiation block of claim 6, wherein a gap separating the booster and the detonator is configured to form a liquid column formed of liquid flowing through the opening.

9. The initiation block of claim 6, wherein the second chamber extends completely through the body.

10. The initiation block of claim 6, wherein the opening extends from an outer surface of the body and terminates at the first chamber.

11. A method for activating a downhole tool in a wellbore, comprising:
- forming a downhole tool to have at least a fluid tight interior, a detonating cord, and a detonator;
- disposing an initiation block inside the fluid tight interior, the initiating block comprising a body having:
  - a first face;
  - a second face opposing the first face;
  - a first chamber extending between the opposing faces and through the body, the first chamber being formed by a first bore serially arranged with a second bore, the second bore seating the detonator adjacent to the second face;
  - a second chamber extending between the opposing faces and through the body, the second chamber being parallel with the first chamber, the second chamber receiving the detonating cord;
  - a passage formed in a wall separating the first chamber and the second chamber, the passage providing the only communication inside of the body between the first chamber and the second chamber;
  - a booster positioned in the first bore and proximate to the first face, the booster positioned along the passage; and
  - an opening formed in the body, the opening providing fluid communication between an exterior of the body and a portion of the first chamber between the booster and the detonator;

connecting the downhole tool to the work string;

conveying the downhole tool through the wellbore using the work string; and transmitting an electric firing signal to the detonator.

* * * * *